US009708777B2

(12) United States Patent
Weatherill et al.

(10) Patent No.: US 9,708,777 B2
(45) Date of Patent: Jul. 18, 2017

(54) RAILROAD TRACK TOOL APPARATUS

(71) Applicant: STANLEY BLACK & DECKER, INC., New Britain, CT (US)

(72) Inventors: Jeffery Weatherill, Portland, OR (US); Gabriel West, Portland, OR (US)

(73) Assignee: STANLEY BLACK & DECKER, INC., New Britain, CT (US)

( * ) Notice: Subject to any disclaimer, the term of this patent is extended or adjusted under 35 U.S.C. 154(b) by 0 days.

(21) Appl. No.: 14/834,005

(22) Filed: Aug. 24, 2015

(65) Prior Publication Data

US 2017/0058461 A1 Mar. 2, 2017

(51) Int. Cl.

| | |
|---|---|
| ***B24B 19/00*** | (2006.01) |
| ***E01B 31/17*** | (2006.01) |
| ***B24B 23/00*** | (2006.01) |

(52) U.S. Cl.

CPC ..... *E01B 31/17* (2013.01); *B24B 19/004* (2013.01); *B24B 23/00* (2013.01)

(58) Field of Classification Search

CPC ... B24B 19/004; B24B 27/0015; B24B 27/04; B24B 55/06; B24B 9/00; B24B 27/00; B24B 23/00; E01B 31/17

USPC ..... 451/236, 429; 269/3, 6, 71; 254/18, 19

See application file for complete search history.

(56) References Cited

U.S. PATENT DOCUMENTS 2,081,360 A * 5/1937 Mall ..... B23D 45/006 451/121
2,118,621 A * 5/1938 Perazzoli ..... E01B 31/17 451/347
2,214,141 A * 9/1940 Mall ..... B23D 45/006 451/121
2,691,505 A * 10/1954 Hursh ..... E01B 29/26 254/18
3,823,455 A * 7/1974 McIlrath ..... E01B 31/17 29/33 R (Continued)

FOREIGN PATENT DOCUMENTS

| | | |
|---|---|---|
| EP | 0 665 332 A1 | 8/1995 |
| EP | 1 178 154 A1 | 2/2002 |
| WO | 2006/031168 A1 | 3/2006 |

OTHER PUBLICATIONS

International Search Report and Written Opinion issued in corresponding International Patent Application No. PCT/US2016/048355, dated Dec. 13, 2016.

*Primary Examiner* — George Nguyen

(74) *Attorney, Agent, or Firm* — Pillsbury Winthrop Shaw Pittman LLP

(57) ABSTRACT

The present disclosure relates to a railroad track tool apparatus. The apparatus comprises a tool configured to perform an operation to the rail of the railroad track, a clamp assembly, and a coupling. The clamp assembly is moveable between a clamped position and an unclamped position to removably couple the tool with the rail. The clamp assembly is moveable along the rail. The coupling is configured to couple the tool to the clamp assembly. The coupling comprises a pivot, a linkage assembly comprising an arm coupled to the pivot, and a head coupled to the linkage assembly. The coupling is configured such that the tool is moveable between an inner side and an outer side of the rail, rotatable toward and away from the inner side or the outer side of the rail, and rotatable toward and away from an underside of the rail.

44 Claims, 14 Drawing Sheets

(56) References Cited

U.S. PATENT DOCUMENTS

| | | | | | |
|---|---|---|---|---|---|
| 3,974,596 | A * | 8/1976 | Huboud-Peron | B23D 45/006 | 451/347 |
| 4,033,074 | A * | 7/1977 | Lutts | B23D 45/006 | 451/347 |
| 4,068,415 | A * | 1/1978 | McIlrath | B23D 45/006 | 451/347 |
| 4,538,793 | A * | 9/1985 | Dieringer | E01B 29/26 | 254/18 |
| 5,992,329 | A * | 11/1999 | Scheuchzer | B23K 11/046 | 104/15 |
| 6,234,889 | B1 * | 5/2001 | Huboud Peron | B23D 45/006 | 125/12 |
| 6,314,853 | B1 * | 11/2001 | Omi | B23D 45/006 | 451/347 |
| 6,663,476 | B1 * | 12/2003 | Story | B24B 19/004 | 451/347 |
| 6,981,907 | B1 * | 1/2006 | Korinek | E01B 31/17 | 451/139 |
| 7,322,879 | B2 * | 1/2008 | Meroz | B24B 19/004 | 451/347 |
| 8,608,143 | B2 * | 12/2013 | Williams | B23K 37/0533 | 269/143 |
| 2002/0019205 | A1 * | 2/2002 | Huboud-Peron | E01B 31/17 | 451/429 |

* cited by examiner

RAILROAD TRACK TOOL APPARATUS

BACKGROUND OF THE INVENTION

1. Field of the Invention

The present disclosure relates to a railroad track tool apparatus that can be mounted on a railroad track rail to perform an operation on the rail.

2. Description of Related Art

Devices configured to support a manually operated tool on railroad tracks are known. Typically, these devices rest on rollers positioned top of one or both rails of a railroad track and are manually pushed, pulled, lifted, and twisted with physical difficulty by users to position the manually operated tool relative to the track.

SUMMARY OF EMBODIMENTS OF THE INVENTION

One aspect of the present disclosure relates to a railroad track tool apparatus. The apparatus comprises a tool, a clamp assembly, a coupling, and/or other components. The tool is configured to perform an operation to a rail of a railroad track. The coupling is configured to couple the tool to the clamp assembly. The clamp assembly is moveable between a clamped position and an unclamped position to removably couple the tool with the rail. The clamp assembly comprises a first bearing structure configured to engage an upper side of the rail, and second and third bearing structures configured to engage an underside of the rail when the clamp assembly is in the clamped position. The clamp assembly is moveable along the rail.

The clamp assembly further comprises fourth and fifth bearing structures configured to move along an inner side and an outer side of the rail to facilitate the movement of the clamp assembly along the rail without binding against the rail, a lever, an adjustment structure, and/or other components. The second and third bearing structures rotate toward the rail to engage the underside of the rail and rotate away from the rail to disengage the underside of the rail. The lever is configured to, when actuated by a user, cause the second and third bearing structures to engage or disengage the underside of the rail. The adjustment structure is configured to adjust a distance between a sixth bearing structure and the second and third bearing structures.

Another aspect of the present disclosure relates to the railroad track tool apparatus. The apparatus comprises the tool, the clamp assembly, the coupling, and/or other components. The tool is configured to perform the operation to the rail of the railroad track. The clamp assembly is configured to removably couple the tool with the rail. The coupling is configured to couple the tool to the clamp assembly. The coupling comprises a pivot that couples the coupling to the clamp assembly. The pivot is configured to facilitate rotation of the coupling to move the tool between an inner side and an outer side of the rail.

In some embodiments, the clamp assembly is configured such that the second, third, and sixth bearing structures are disposed toward a first end of the clamp assembly; the first, fourth, and fifth bearing structures are disposed toward a second end of the clamp assembly; and the coupling is coupled to the clamp assembly toward the second end of the clamp assembly near the first, fourth, and fifth bearing structures. In some embodiments, the first end of the clamp assembly is clamped to the rail and the pivot couples the coupling to the clamp assembly toward the second end of the clamp assembly. In some embodiments, the coupling has a first end and a second end opposite the first end, and the coupling is coupled to the clamp assembly via the pivot toward the first end of the coupling. In some embodiments, the clamp assembly extends along the rail from the first end of the clamp assembly to the second end of the clamp assembly, and the pivot is positioned above the rail and couples the coupling to the clamp assembly toward the second end of the clamp assembly. In some embodiments, the pivot includes a hard stop and a retractable detent configured to limit rotation of the coupling. In some embodiments, the hard stop and retractable detent are configured to allow enough rotation of the coupling such that the tool is positionable on the inner side or the outer side of the rail.

Yet another aspect of the present disclosure relates to the railroad track tool apparatus. The apparatus comprises the tool configured to perform the operation to the rail of the railroad track, the clamp assembly configured to removably couple the tool with the rail, the coupling configured to couple the tool to the clamp assembly, and/or other components. The coupling comprises a linkage assembly configured to facilitate movement of the tool toward and away from the rail. The linkage assembly includes a spring structure. A gravitational weight of the tool is countered by a spring force provided by the spring structure. This may, for example, make it easier for a user to manipulate the tool. The linkage assembly is moved by the user via a tool handle to move the tool toward and away from the rail.

In some embodiments, the linkage assembly comprises a four bar link assembly. In some embodiments, the spring structure of the linkage assembly includes a gas spring, a tension spring, a compression spring, a torsion spring, and/or other springs. The four bar link assembly and the gas spring (e.g., and/or other springs) are configured to support the weight of the tool such that the perceived weight of the tool felt by the user is reduced compared to the actual weight of the tool.

In some embodiments, the coupling includes a pivot and the linkage assembly comprises an arm coupled to the clamp assembly via the pivot. The pivot is configured to facilitate rotation of the arm to move the tool between the inner side and the outer side of the rail. The arm has a first end and a second end opposite the first end, and the arm is coupled to the clamp assembly via the pivot toward the first end of the arm. The arm extends away from the pivot, and the tool is coupled with the coupling toward the second end of the arm. The arm is moved by the user (via the tool handle) to position the tool on the outer side or the inner side of the rail.

Yet another aspect of the present disclosure relates to the railroad track tool apparatus. The apparatus comprises the tool configured to perform the operation to the rail of the railroad track, the clamp assembly configured to removably couple the tool with the rail, the coupling configured to couple the tool to the clamp assembly, and/or other components. The coupling comprises a head configured to couple with the tool and/or other components. The head is configured to rotate about a first axis such that the tool is moveable toward and away from the inner side or the outer side of the rail, and rotate about a second axis such that the tool is moveable toward and away from the underside of the rail. In some embodiments, the head comprises a gimbal rotation mechanism. The tool is coupled to the gimbal rotation mechanism via a bearing and/or other coupling devices. Such coupling devices may include a sealed bearing and/or other bearings, for example. In some embodiments, the gimbal rotation mechanism may be configured with two axis of rotation (e.g., a double gimbal rotation mechanism). In such embodiments, the gimbal rotation mechanism includes a base, an inner gimbal rotation mechanism, an outer gimbal rotation mechanism, and/or other components. The inner gimbal rotation mechanism and the outer gimbal rotation mechanism are coupled via revolute joints. However, the description herein of the double gimbal rotation mechanism is not intended to be limiting. In some embodiments, the gimbal rotation mechanism may be a three axis rotation mechanism including any components and/or having any structure configured for three axis rotation.

In some embodiments, the head further comprises a hard stop and a retractable pin lock that limit the rotation of the head about the second axis. In some embodiments, the head is configured such that the first axis is a substantially vertical axis and the second axis is a substantially horizontal axis relative to the rail.

In some embodiments, the tool is a grinder, an inspection device, and/or other tools. In some embodiments, the operation performed by the tool to the railroad track comprises a grinding operation, an inspection operation, and/or other operations. In some embodiments, the tool is coupled with the coupling toward the second end of the coupling.

These and other aspects of various embodiments of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only and are not intended as a definition of the limits of the invention. In addition, it should be appreciated that structural features shown or described in any one embodiment herein can be used in other embodiments as well. As used in the specification and in the claims, the singular form of "a", "an", and "the" include plural referents unless the context clearly dictates otherwise.

All closed-ended (e.g., between A and B) and open-ended (greater than C) ranges of values disclosed herein explicitly include all ranges that fall within or nest within such ranges. For example, a disclosed range of 1-10 is understood as also disclosing, among other ranged, 2-10, 1-9, 3-9, etc.

BRIEF DESCRIPTION OF THE DRAWINGS

For a better understanding of embodiments of the present invention as well as other objects and further features thereof, reference is made to the following description which is to be used in conjunction with the accompanying drawings, where.

DETAILED DESCRIPTION OF EXEMPLARY EMBODIMENTS OF THE INVENTION

Figure 1:
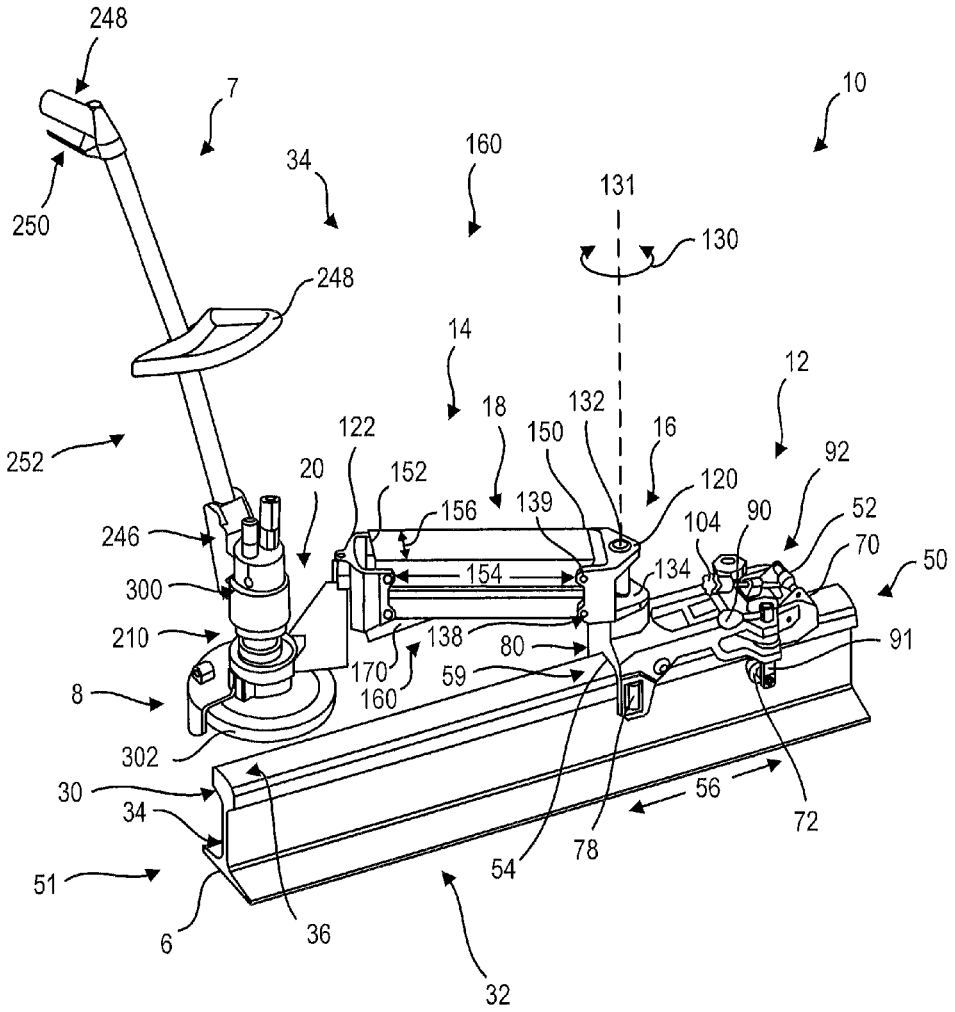
FIG. 1 illustrates a railroad track tool apparatus that can be mounted to a rail of a railroad track.

FIG. 1 illustrates a railroad track tool apparatus 10. Apparatus 10 can be mounted on a railroad track rail 6 to perform an operation on rail 6. Apparatus 10 comprises a manually operated tool 8, a clamp assembly 12, a coupling 14, and/or other components. Clamp assembly 12, coupling 14, and/or other components of apparatus 10 provide support to the manually operated tool 8 and/or other tools for working on and/or around railroad tracks. Apparatus 10 couples with a single rail 6 of a railroad track instead of straddling and/or being otherwise coupled with both rails of the railroad track. Clamp assembly 12, coupling 14, and/or other components of apparatus 10 enable manipulation and articulation of tool 8 by an operator working on the railroad track (and/or other operators) to facilitate access to various areas of the railroad track (e.g., an underside 30 of rail 6).

Clamp assembly 12 is located at a first end 50 of apparatus 10. Clamp assembly 12 extends along rail 6 from a first end 52 of clamp assembly 12 to a second end 54 of clamp assembly 12. In some embodiments, clamp assembly has a length 56 of up to about 15 inches. In some embodiments, length 56 is between about 11 inches and about 15 inches. In some embodiments, length 56 is about 13 inches. Clamp assembly 12 clamps around an inner side 32 and an outer side 34 of rail 6 and engages an upper side 36 and underside 30 of rail 6. Clamp assembly 12 is moveable along rail 6. Clamp assembly 12 is moveable along rail 6 such that a user may move tool 8 back and forth along rail 6 to perform an operation to the rail 6 at any location on rail 6 (and/or on the other rail of the railroad track).

Figure 2A:
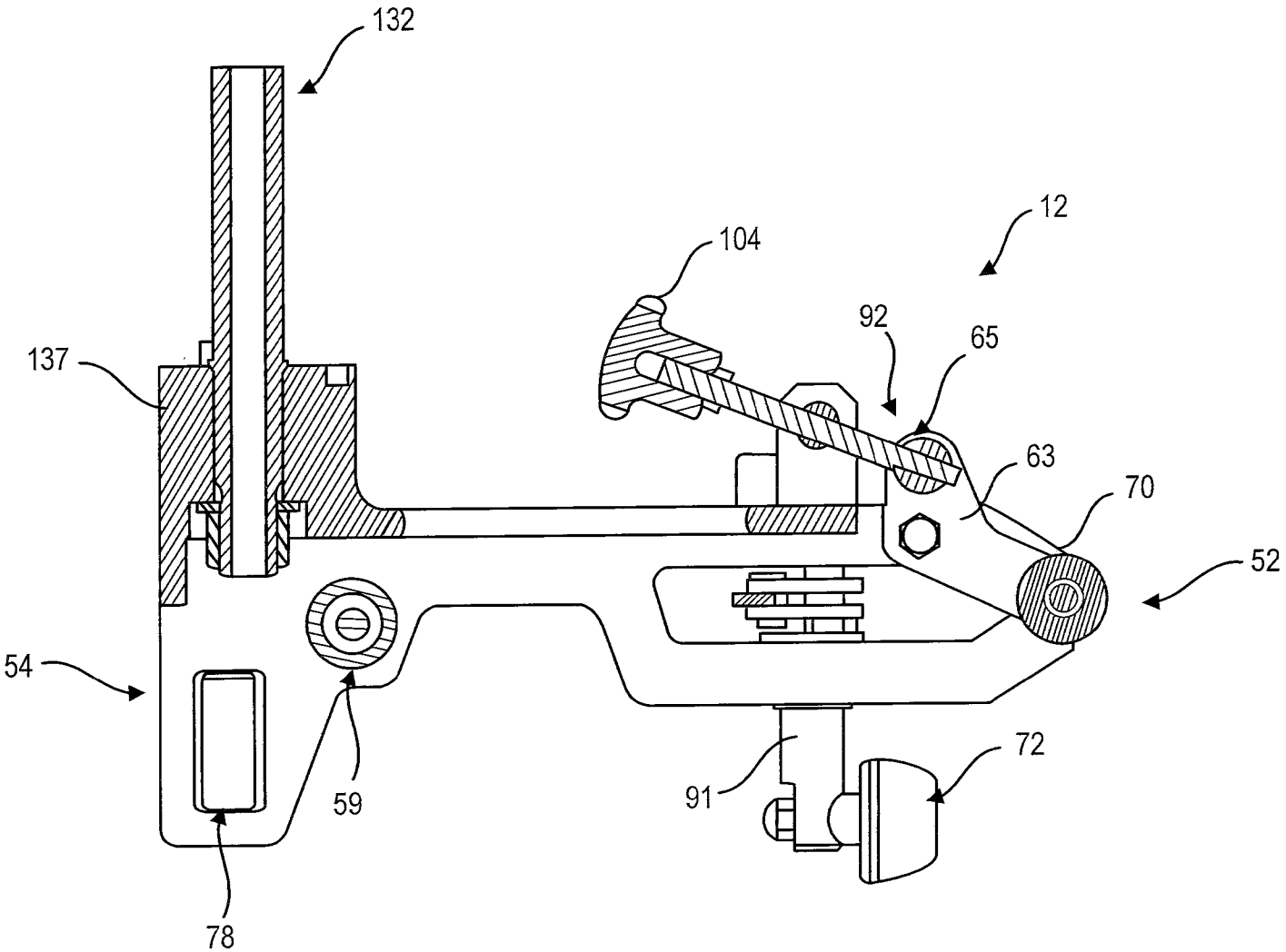
FIG. 2A illustrates a sectional side view of a clamp assembly of the railroad track tool apparatus.
Figure 2B:
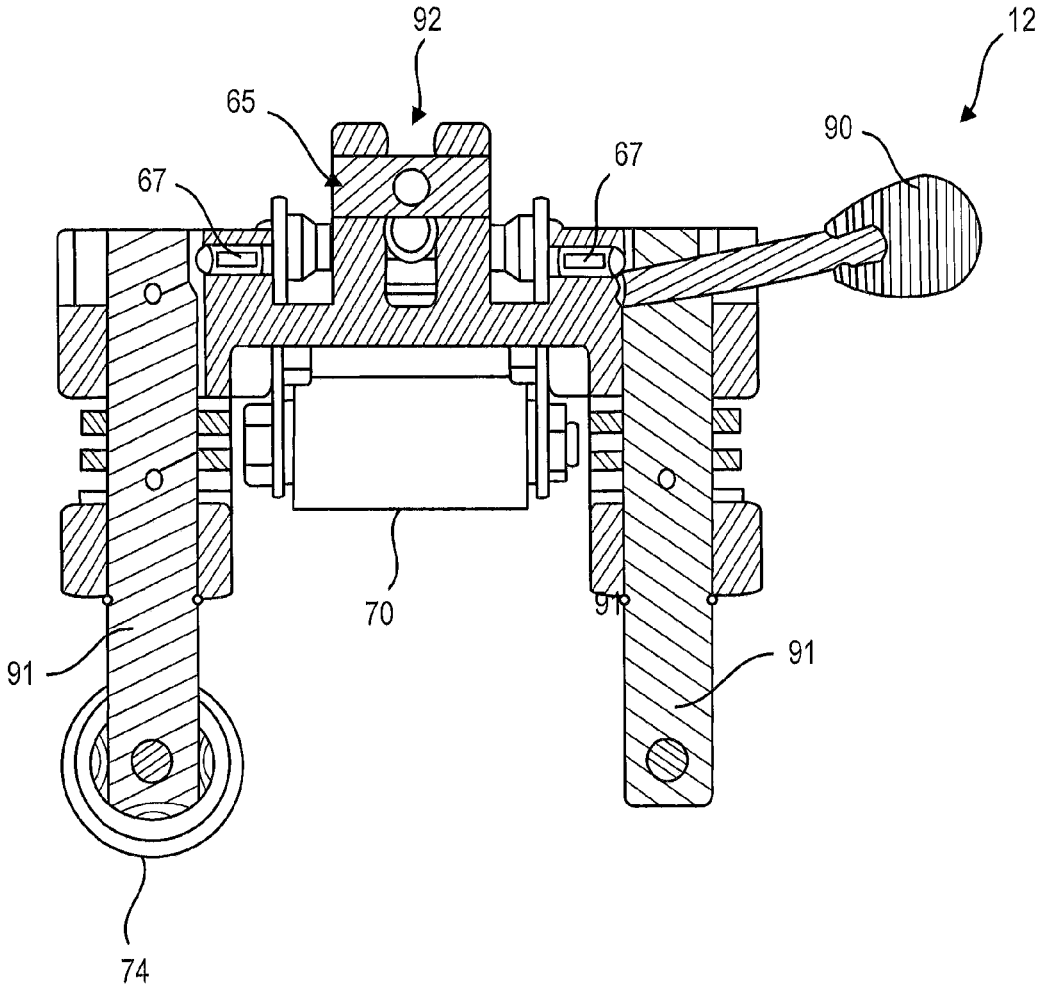
FIG. 2B illustrates a sectional end view of the clamp assembly.
Figure 2C:
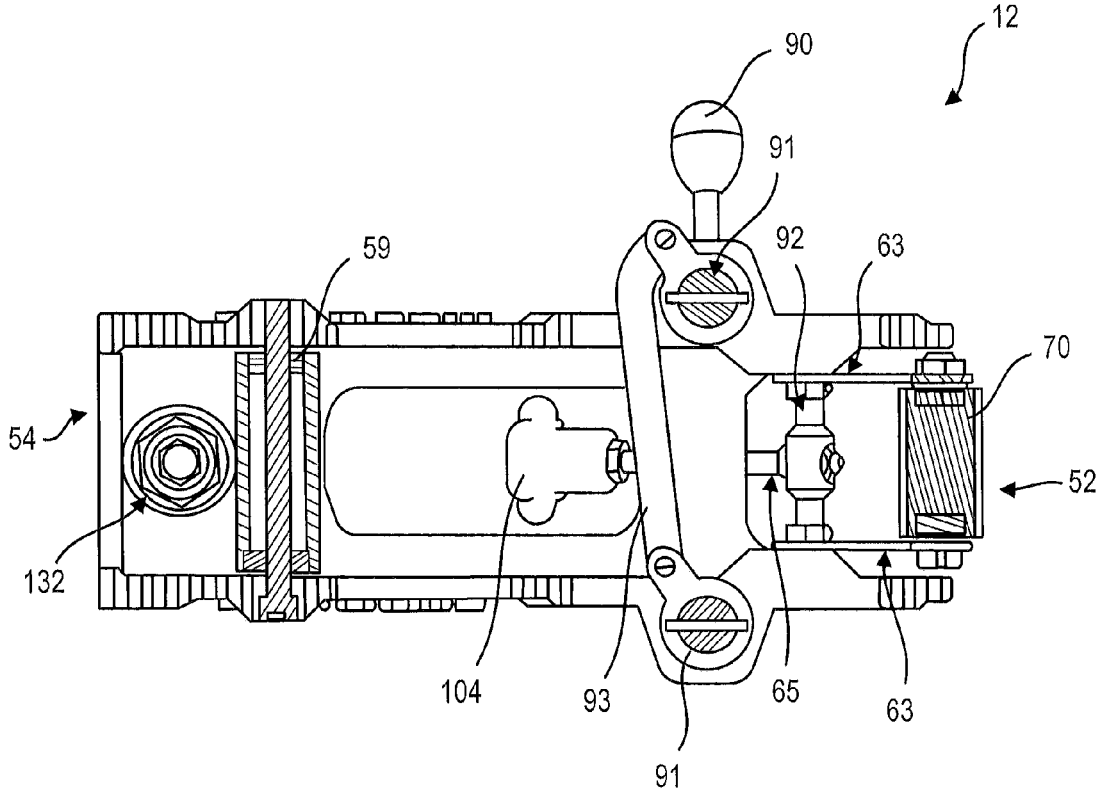
FIG. 2C illustrates a sectional top view of the clamp assembly.
Figure 2D:
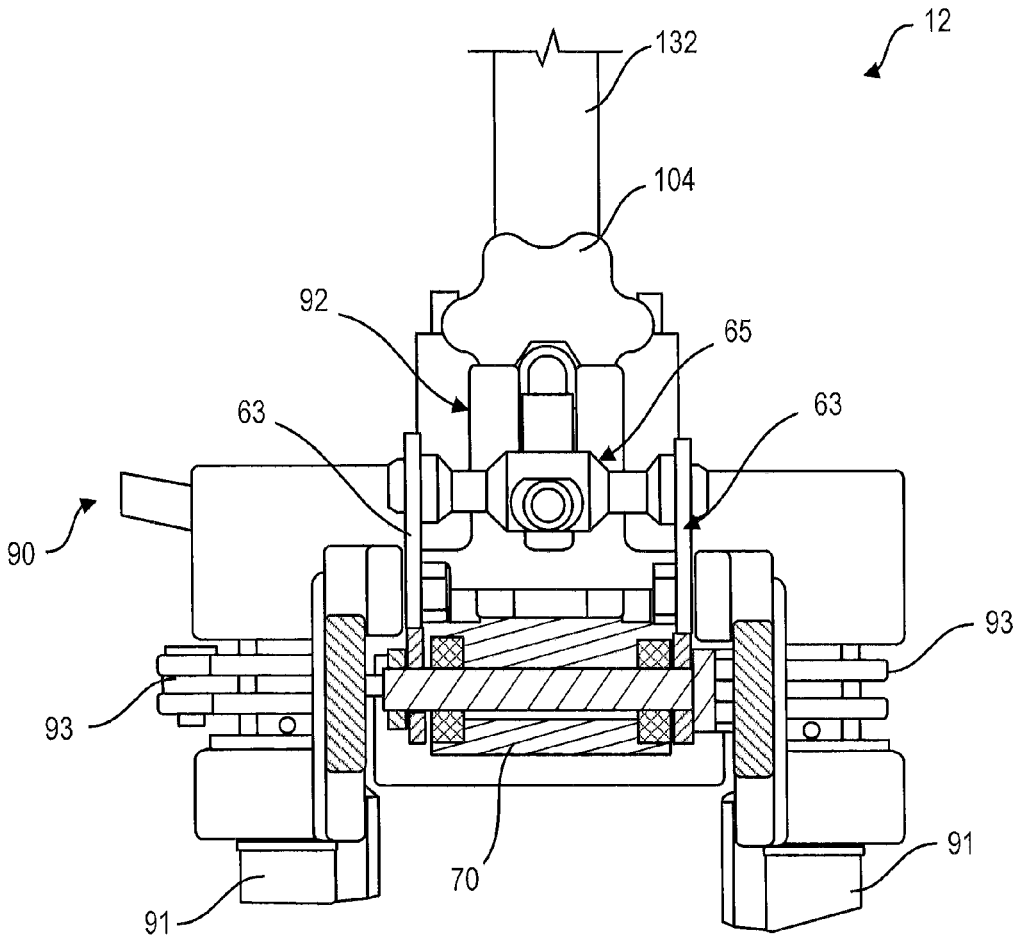
FIG. 2D illustrates another sectional end view of the clamp assembly.

Clamp assembly 12 is moveable between a clamped position and an unclamped position to removably couple tool 8 with rail 6. Various views of clamp assembly 12 are illustrated in FIG. 2A-2E and FIG. 3-4. FIG. 2A illustrates a sectional side view (e.g., looking from inner side 32) of clamp assembly 12. FIG. 2B illustrates a sectional end view (e.g., looking from second end 54) of clamp assembly 12. FIG. 2C illustrates a sectional top view of clamp assembly 12. FIG. 2D illustrates another sectional end view (e.g., looking from first end 52) of clamp assembly 12. Clamp assembly 12 is illustrated in a clamped position 60 in FIG. 2E and an unclamped position 62 in FIG. 3. FIG. 4 illustrates an end view (e.g., looking from first end 50 of apparatus 10/first end 52 of clamp assembly 12) showing clamp assembly 12 in clamped position 60 on rail 6. As shown in FIG. 1, 2A-2E and FIG. 3-4, clamp assembly 12 comprises a first (e.g., primary) bearing structure 59, second and third bearing structures 72 and 74, fourth and fifth bearing structures 78, 80, and a sixth bearing structure 70. Bearing structures 59, 72, 74, 78, 80, and 70 are shown in the figures and described herein as rollers (e.g., first roller 59, second and third rollers 72 and 74, fourth and fifth rollers 78 and 80, and sixth roller 70). This is not intended to be limiting. Bearing structures 59, 72, 74, 78, 80, and 70 may be and/or include any devices that allow clamp assembly 12 to move along rail 6 as described herein. For example, bearing structures 59, 72, 74, 78, 80, and 70 may be and/or include rollers and/or other rollable bearings, reduced friction surfaces (e.g., metal and/or polymer), sliding components, and/or other bearing structures.

Figure 2E:
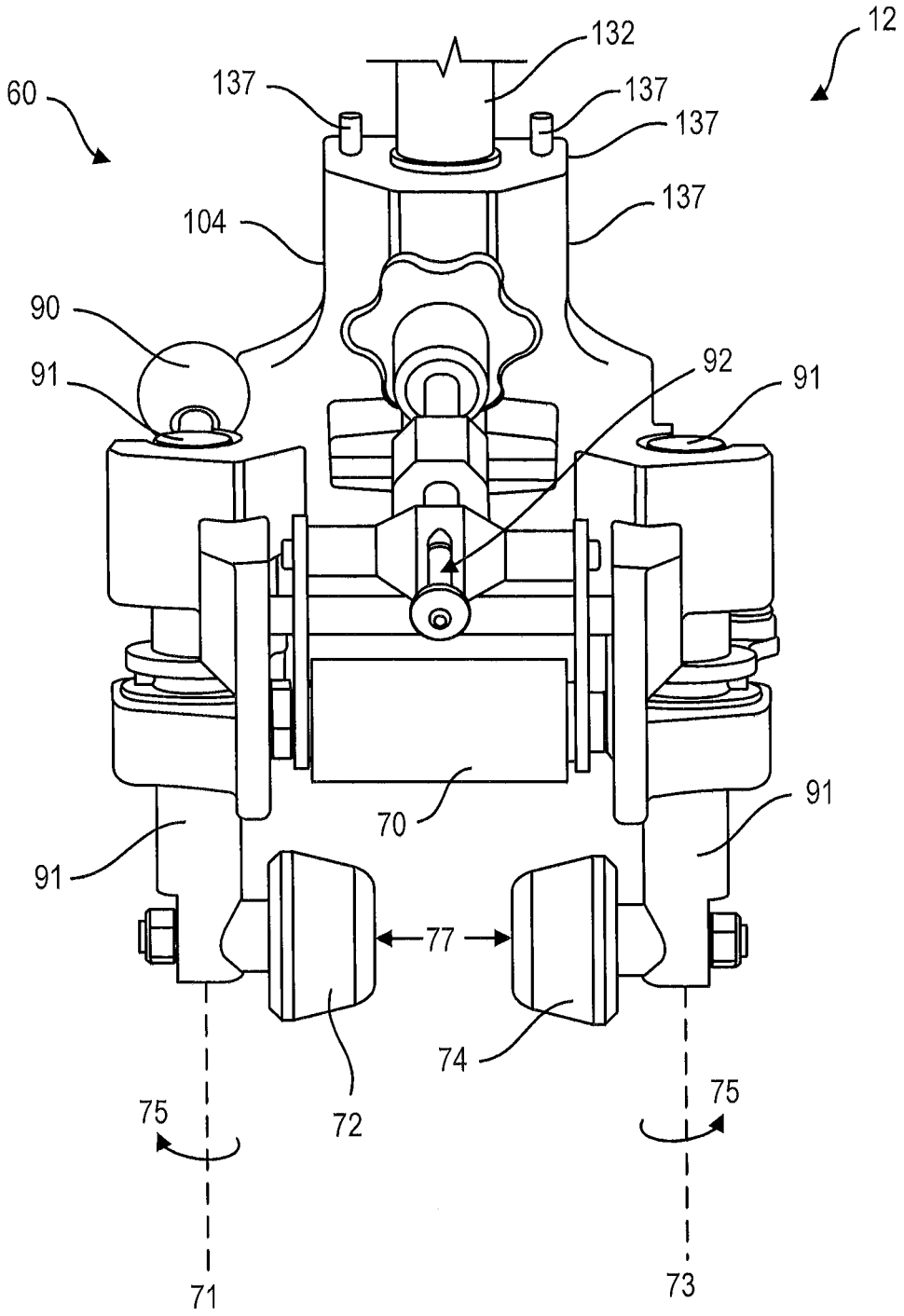
FIG. 2E illustrates the clamp assembly in a clamped position.

First roller/bearing structure 59 is configured to engage upper side 36 (FIG. 4) of rail 6, and second 72 and third 74 rollers/bearing structures are configured to engage underside 30 of rail 6 when clamp assembly 12 is in clamped position 60 (FIG. 2E, FIG. 4). Apparatus 10 (FIG. 1) pivots about first roller 59. Rollers 72 and 74 are located toward first end 52 of clamp assembly 12 (FIG. 1, 2B). Rollers 72 and 74 may react against vertical components of a moment created by tool 8 via coupling 14 on clamp assembly 12, for example, and/or perform other functions. In some embodiments, rail 6 may have a substantially "T" shaped cross section (FIG. 4). In some embodiments, second roller 72 is located on inner side 32 of rail 6 (FIG. 4) and third roller 74 is located on outer side 34 of rail 6 (FIG, 4). Second 72 and third 74 rollers rotate 76 (FIG, 2E, FIG. 3) toward rail 6 about axes of rotation 71 and 73 respectively to engage underside 30 of rail 6. Second 72 and third 74 rollers rotate 75 away from rail 6 to disengage underside 30 of rail 6.

Figure 3:
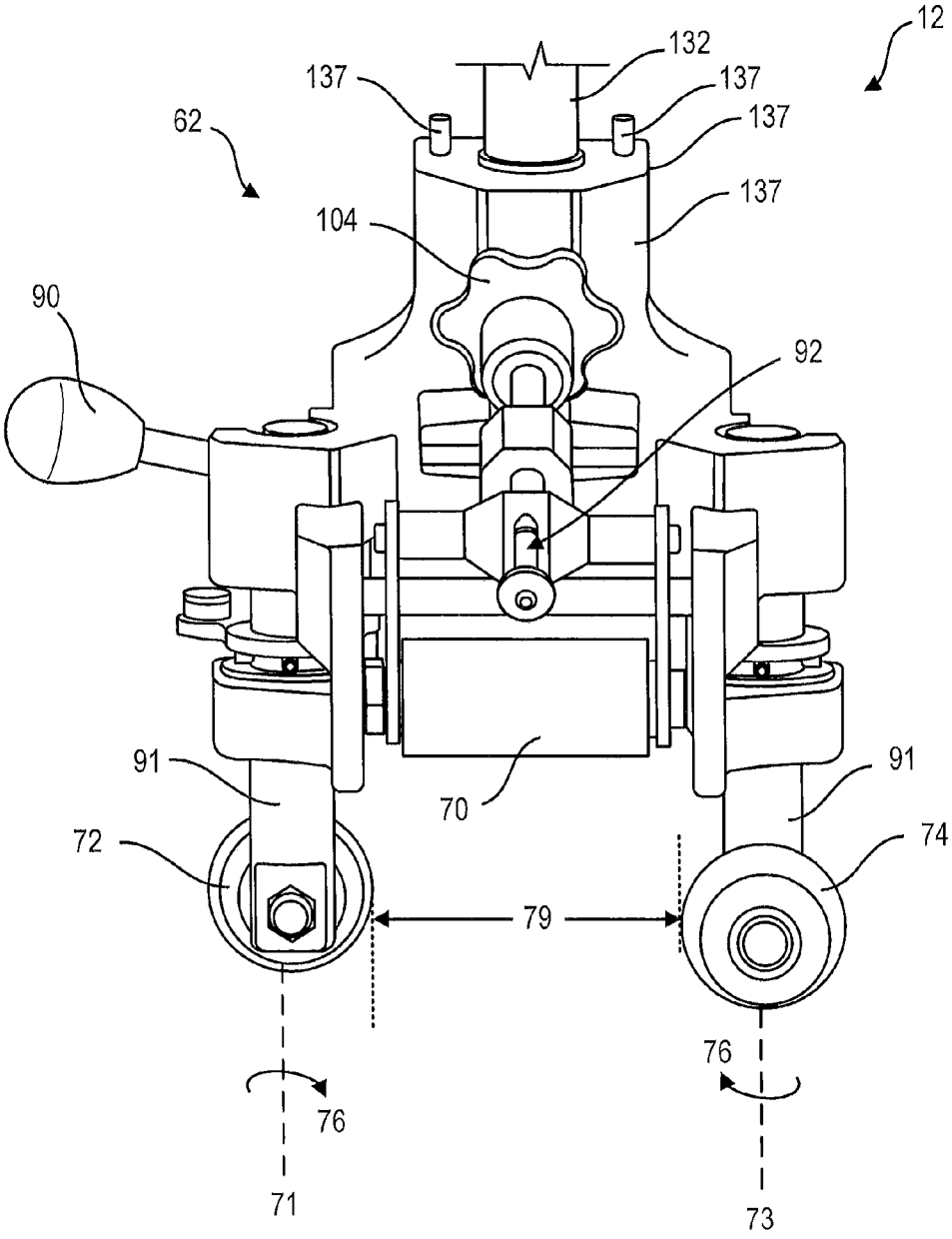
FIG. 3 illustrates the clamp assembly in an unclamped position.
Figure 4:
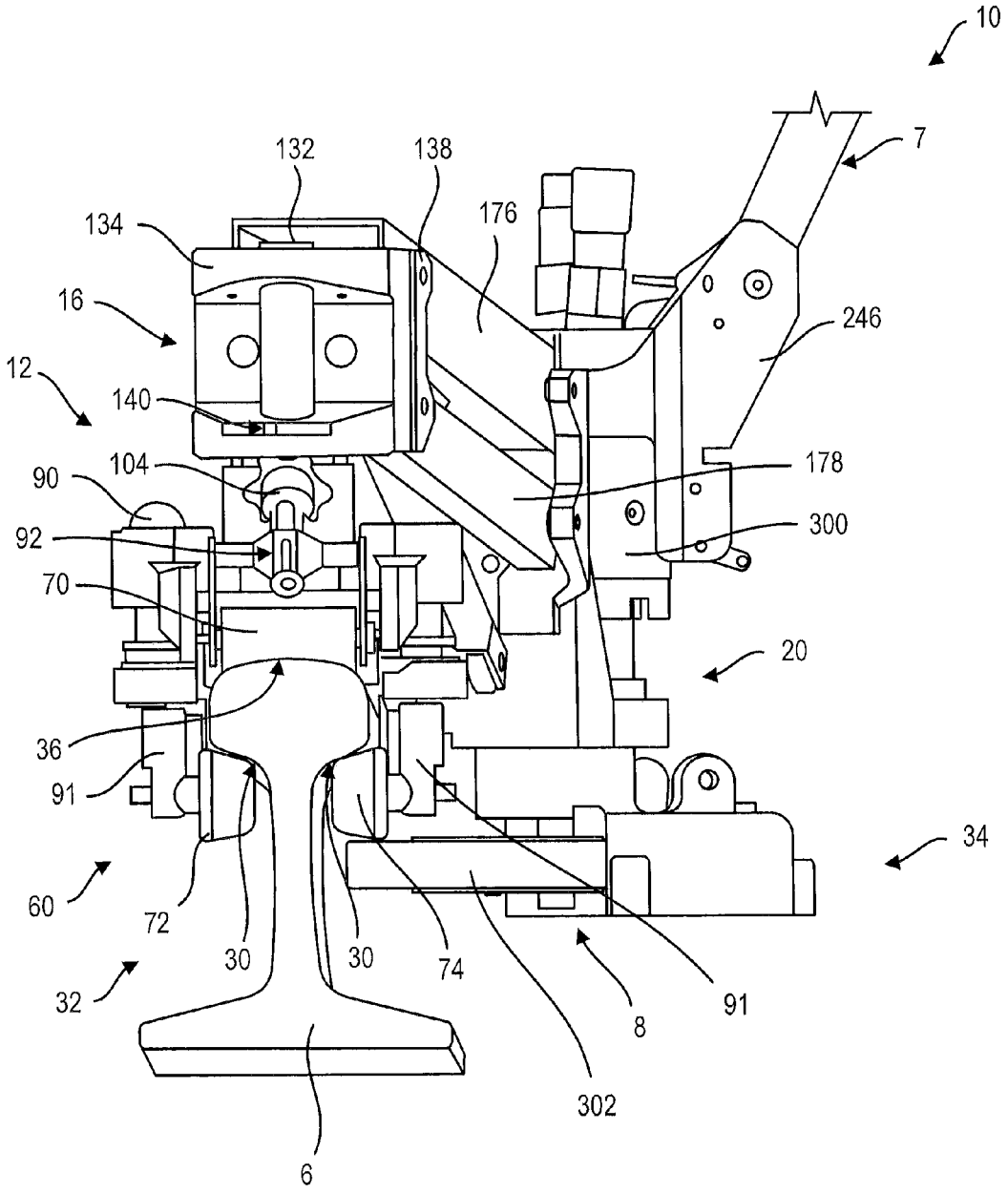
FIG. 4 illustrates an end view of the apparatus showing the clamp assembly in the clamped position on the rail.

Clamp assembly 12 may be installed on and/or removed from rail 6 when clamp assembly 12 is in unclamped position 62 (FIG. 3). For example, rollers 72, 74 may fit around and/or may be maneuvered to fit around the wide portion of the "T" shape of rail 6 to install and/or remove clamp assembly 12 from rail 6. Rollers 72, 74 may be positioned under the wide portion of the "T" of rail 6 on underside 30 of rail 6 in clamped position 60 (e.g., as shown in FIG. 4).

In some embodiments, a distance 77 between second and third rollers 72, 74 may be up to about 2 inches when clamp assembly 12 is in clamped position 60 (FIG. 2E). In some embodiments, distance 77 may be between about 1 inch and about 2 inches. In some embodiments, distance 77 may be about 1.44 inches. In some embodiments, a distance 79 between second and third rollers 72, 74 may be up to about 4 inches when clamp assembly 12 is in unclamped position 62 (FIG. 3). In some embodiments, distance 79 is between about 2 inches and about 4 inches. In some embodiments, distance 79 is about 3.25 inches, However, distances 77 and 79 are not intended to be limiting. Distance 77 may be any distance that allows clamp assembly 12 to be clamped to rail 6 in clamped position 60 (FIG. 2E). Distance 79 may be any distance that allows clamp assembly 12 to be installed and/or removed from rail 6 when clamp assembly 12 is in unclamped position 62 (FIG. 3). Distances 77 and 79, and/or other distances, may be adjusted and/or changed based on the dimensions of rail 6 such that apparatus 10 functions as described herein.

Figure 5:
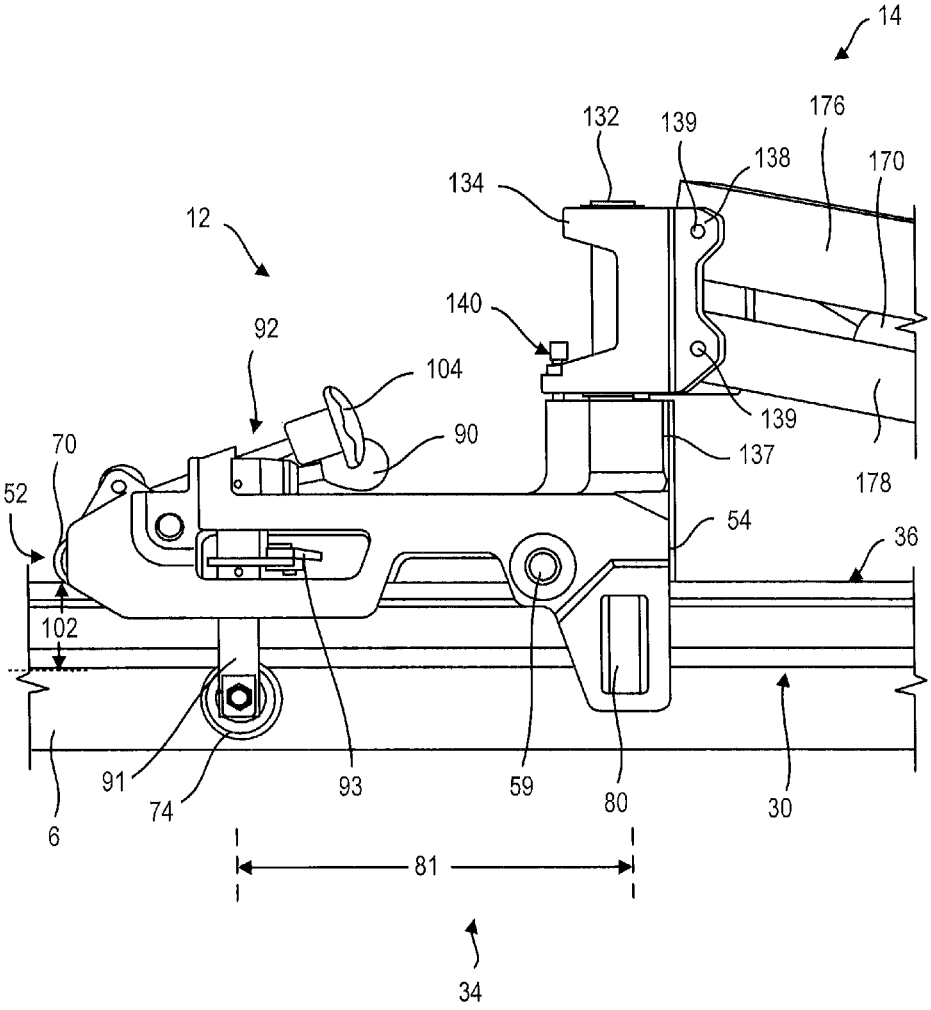
FIG. 5 illustrates a side view of the clamp assembly and a pivot of a coupling.
Figure 6:
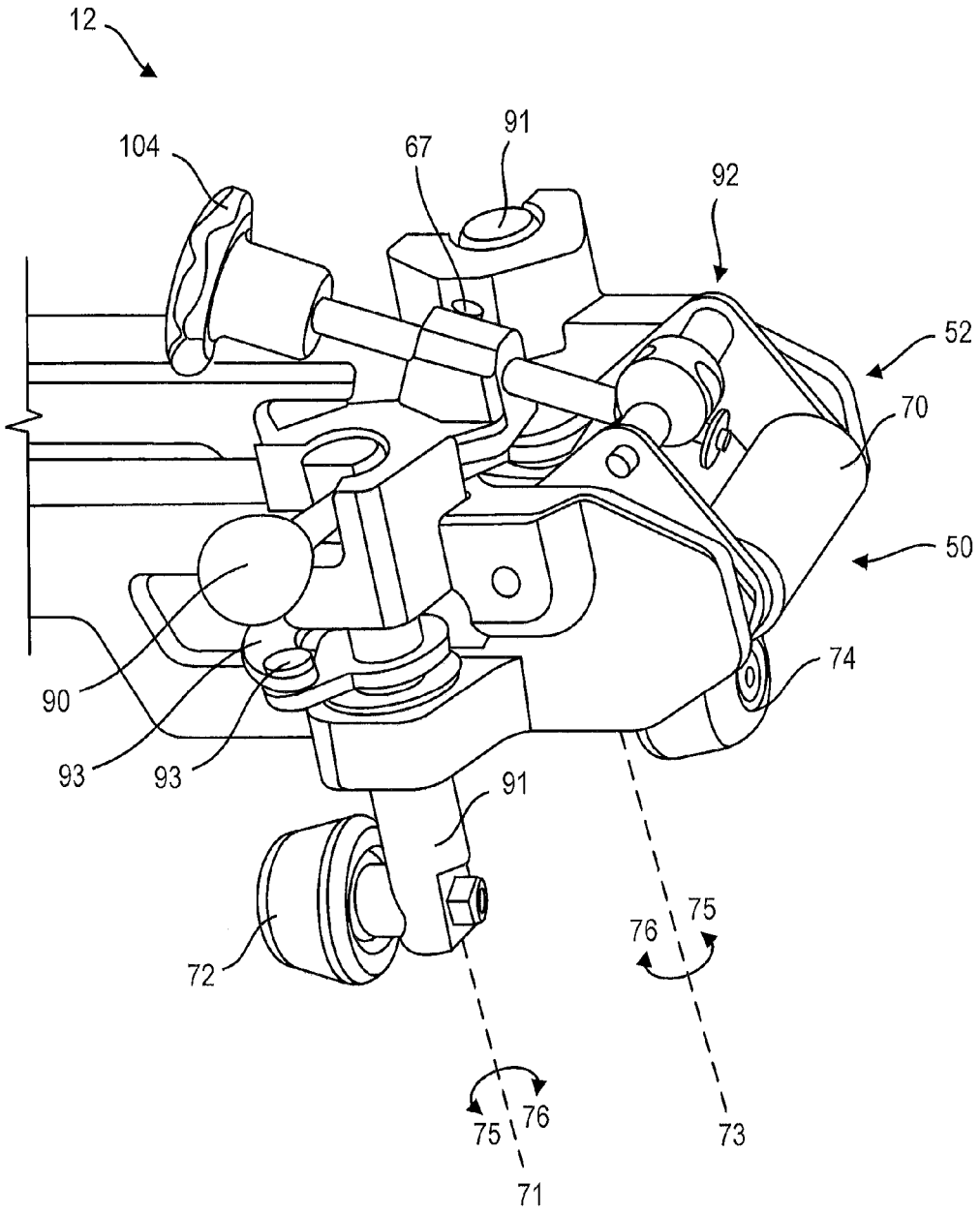
FIG. 6 illustrates a perspective view of a first end of the clamp assembly.

FIG. 5 illustrates a side view (e.g., looking from outer side 34) of clamp assembly 12. FIG. 6 illustrates a perspective view of first end 52 of clamp assembly 12. As shown in FIG. 5 and FIG. 6, clamp assembly 12 comprises fourth 78 (FIG. 1) and fifth 80 rollers/bearing structures, sixth roller/bearing structure 70, a lever 90, an adjustment structure 92, and/or other components. Fourth and fifth rollers 78, 80 are configured to roll along inner side 32 (fourth roller 78) and outer side 34 (fifth roller 80) of rail 6 to facilitate movement of clamp assembly 12 along rail 6 without binding against rail 6. Sixth roller 70 is configured to roll along upper side 36 of rail 6 when clamp assembly 12 moves. Sixth roller 70 is an adjustment roller (described below) for different rail head sizes and provides a reaction point when clamp assembly 12 is travelling back and forth on rail 6, First roller 59, and fourth and fifth rollers 78, 80 are located toward second end 54 of clamp assembly 12 (FIG. 5). As shown in FIG. 5, second roller 74 and fifth roller 80 are separated by a distance 81 (between roller centers) of up to about 10 inches. In some embodiments, distance 81 is between about 6 inches and about 10 inches. In some embodiments, distance 81 is about 8.25 inches.

Lever 90 and adjustment structure 92 are located toward first end 52 of clamp assembly 12 and disposed above upper side 36 of rail 6, Lever 90 is configured to, when actuated by a user, cause the second 72 and third 74 rollers to engage and/or disengage underside 30 of rail 6 (FIG. 5). Lever 90 causes the second 72 and third 74 rollers to rotate 76 about respective axes of rotation 71 (second roller 72) and 73 (third roller 74) toward rail 6 to engage rail 6 and rotate 75 (about the same axes) away from rail 6 to disengage rail 6. In some embodiments, rollers 72 and 74 rotate about 90° in substantially opposite directions (e.g., roller 72 rotates toward second end 54 (FIG. 1) and roller 74 rotates toward first end 52 (FIG. 1), and vice versa) to engage and/or disengage rail 6. In some embodiments, lever 90 may be rotated about 90° (this angle is not intended to be limiting) in a clockwise direction (this direction is not intended to be limiting) to cause rollers 72 and 74 to engage rail 6, and about 90° (this angle is not intended to be limiting) in a counterclockwise direction (this direction is not intended to be limiting) to cause rollers 72 and 74 to disengage rail 6. Lever 90 may cause rotation of rollers 72, 74 by way of one or more axles 91 and/or other components. One or more axles 91 may be coupled with rollers 72, 74. Lever 90 may be coupled with one or more axles 91 (e.g., by axle coupling components 93 shown in FIG. 6) and cause rotation of axles 91 when lever 90 is actuated by a user. For example, actuation of lever 90 by a user may in turn cause rotation of axles 91, which then cause rotation of rollers 72, 74, Lever 90 may be coupled with axles 91 and/or axles 91 may be coupled with rollers 72, 72 via one or more axle coupling components 93 such as brackets, nuts, bolts, screws, fasteners, clamps, clips, hinges, sleeves, blocks, dowels, pins, and/or other coupling devices 93. For example, as shown in in FIG. 6, lever 90 may be directly coupled with an axle 91 that is coupled with roller 72. Lever 90 may be indirectly coupled via axle coupling components 93 with an axle 91 that rotates roller 74. In some embodiments, spring loaded detents 67 (only the detent along axis 73 is shown in FIG. 6 but this is not intended to be limiting) engage axles 91 along axes 71 and 73 to secure lever 90 in place after the rollers are moved to the desired location (e.g., clamped or unclamped).

Adjustment structure 92 is configured to adjust a distance 102 (FIG. 5) along inner side 32/outer side 34 between sixth roller 70 and second and third rollers 72, 74. Distance 102 may be adjusted by a user via a handle 104 and/or other components of adjustment structure 92. In some embodiments, adjustment structure 92 may include a threaded rod 65 (shown in FIG. 1D and 1E) which pushes and/or pulls a link 63 coupled with roller 70 to adjust distance 102 and/or other distances. Distance 102 may be adjusted based on the dimensions of rail 6 and/or for other reasons.

Returning to FIG. 1, coupling 14 is configured to couple tool 8 to clamp assembly 12. In one embodiment, coupling 14 includes a pivot 16, a linkage assembly 160, a head 20, and/or other components. As described above, clamp assembly 12 is configured such that second, third, and sixth rollers 70, 72, 74 (FIG. 2E) are disposed toward first end 52 of clamp assembly 12; and first, fourth, and fifth rollers 59, 78, 80 (FIG. 5) are disposed toward second end 54 of clamp assembly 12. Coupling 14 is coupled to clamp assembly 12 toward second end 54 of clamp assembly 12 near first, fourth, and fifth rollers 59, 78, 80.

Pivot 16 and/or other components couple coupling 14 to clamp assembly 12. Pivot 16 is configured to facilitate rotation 130, about an axis of rotation 131, of coupling 14 to move tool 8 between inner side 32 and outer side 34 of rail 6. Pivot 16 couples coupling 14 to clamp assembly 12 toward second end 54 of clamp assembly 12. Coupling 14 has a first end 120 and a second end 122 opposite first end 120. Coupling 14 is coupled to clamp assembly 12 via pivot 16 toward first end 120 of coupling 14. Pivot 16 is positioned above rail 6 and couples coupling 14 to clamp assembly 12 toward second end 54 of clamp assembly 12 and first end 120 of coupling 14.

In some embodiments, pivot 16 may be and/or include a cylindrical joint and/or other joints that facilitate rotation. For example, pivot 16 may include a cylindrical portion 132, a collar portion 134, and/or other portions. Cylindrical portion 132 may extend from clamp assembly 12 away from upper side 36 of rail 6 in a direction along axis 131 that is substantially normal (e.g., perpendicular) to upper side 36 of rail 6. In some embodiments, cylindrical portion 132 may be and/or form a portion of clamp assembly 12. In such embodiments, cylindrical portion 132 may be coupled with clamp assembly 12 via one or more cylinder coupling components 137 such as brackets, nuts, bolts, screws, fasteners, clamps, clips, hinges, sleeves, blocks, dowels, pins, and/or other coupling devices (FIG. 2E, 3, 5). Collar portion 134 is movably coupled with cylindrical portion 132 such that collar portion 134 rotates 130 around cylindrical portion 132 to facilitate the movement of tool 8 between inner side 32 and outer side 34 of rail 6 (e.g., via coupling portions 138 of collar portion 134 and arm 18 described below).

Figure 7:
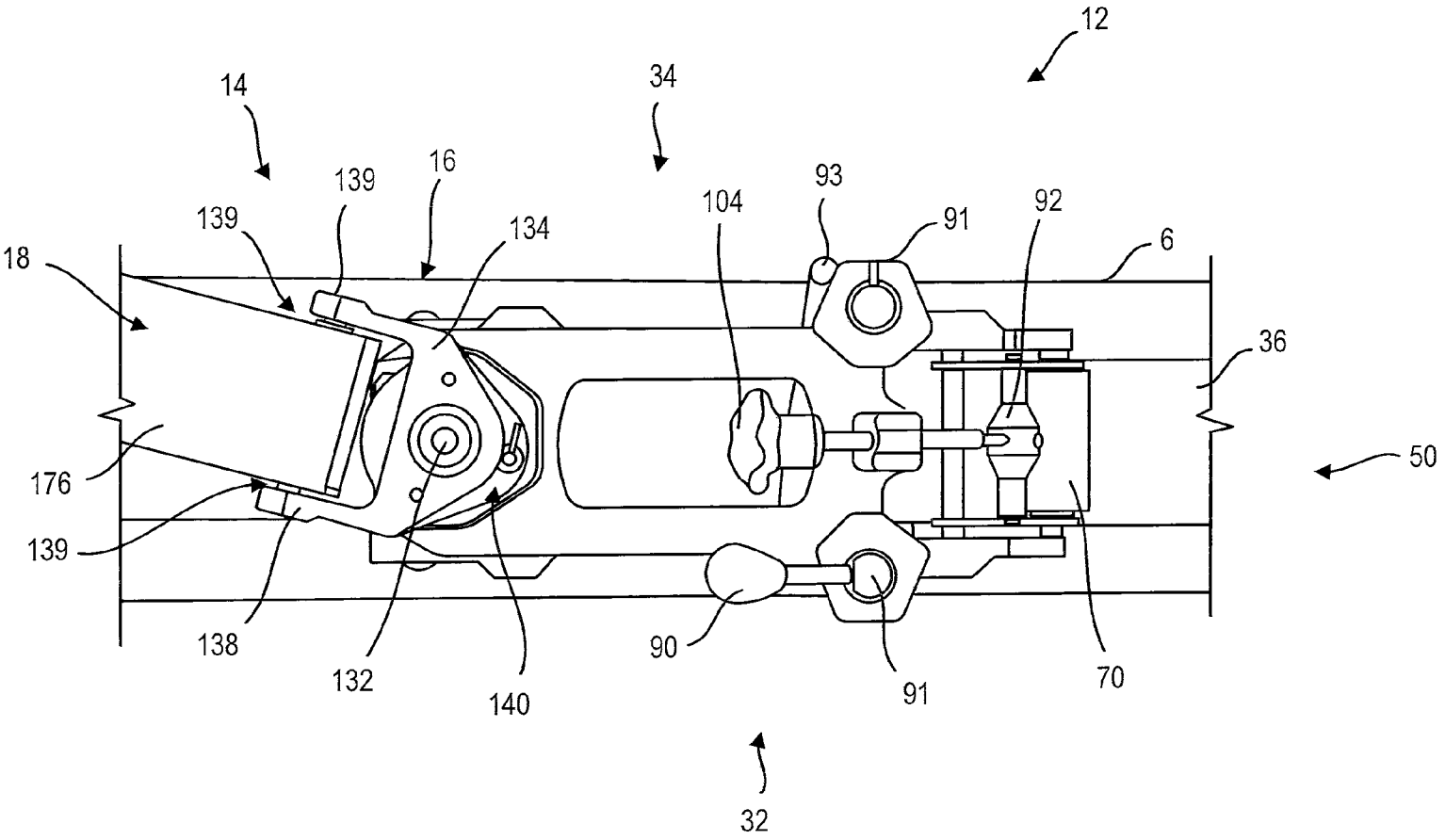
FIG. 7 illustrates a top view of the clamp assembly and a portion of the coupling that includes the pivot.

In some embodiments, pivot 16 includes a hard stop and/or a retractable detent configured to limit rotation of coupling 14. Hard stop/retractable detent 140 is illustrated in FIG. 7. FIG. 7 illustrates a top view of clamp assembly 12 and a portion of coupling 14 that includes pivot 16. Hard stop/retractable detent 140 may be configured to engage collar portion 134 to limit rotation of collar portion 134 around cylindrical portion 132. In some embodiments, hard stop/retractable detent 140 is configured to allow enough rotation of coupling 14 such that tool 8 is positionable on inner side 32 or outer side 34 of rail 6 without unclamping clamping assembly 12 from rail 6. For example, hard stop/retractable detent 140 may allow up to about 180° of rotation (e.g., with about 90° of rotation on either side of rail 6). In some embodiments, hard stop/retractable detent 140 may allow up to about 90° of rotation (e.g., with about 45° of rotation on either side of rail 6). In some embodiments, hard stop/retractable detent 140 may allow up to about 45° of rotation (e.g., with about 22.5° of rotation on either side of rail 6).

As illustrated in FIG. 1 and FIG. 7, linkage assembly 160 is coupled to clamp assembly 12. Linkage assembly 160 is coupled to clamp assembly 12 via pivot 16 and/or other coupling devices. In some embodiments, linkage assembly 160 is coupled to pivot 16 via one or more coupling portions 138 of collar portion 134. Linkage assembly 160 may be coupled to coupling portions 138 via coupling mechanisms 139 such as brackets, nuts, bolts, screws, fasteners, clamps, clips, hinges, sleeves, blocks, dowels, pins, and/or other coupling mechanisms. Linkage assembly 160 is moveable (e.g., by a user) in three dimensions to position tool 8 (FIG. 1) on outer side 34 or inner side 32 of rail 6, above or below upper side 36 of rail 6, and/or in other locations. Arm 18 has a first end 150 and a second end 152 (FIG. 1) opposite first end 150. In some embodiments, linkage assembly 160 comprises an arm 18. Arm 18 is coupled to clamp assembly 12 via pivot 16 toward first end 150 of arm 18. Arm 18 extends away from pivot 16, and tool 8 is coupled with coupling 14 toward second end 152 of arm 18. In some embodiments, arm 18 has a length 154 (FIG. 1) of up to about 18 inches. In some embodiments, length 154 is between about 12 inches and about 18 inches. In some embodiments, length 154 is about 14 inches. In some embodiments, arm 18 has a width 156 of up to about 6 inches. In some embodiments, width 156 is between about 2 inches and about 6 inches. In some embodiments, width 156 is about 4 inches.

Figure 8:
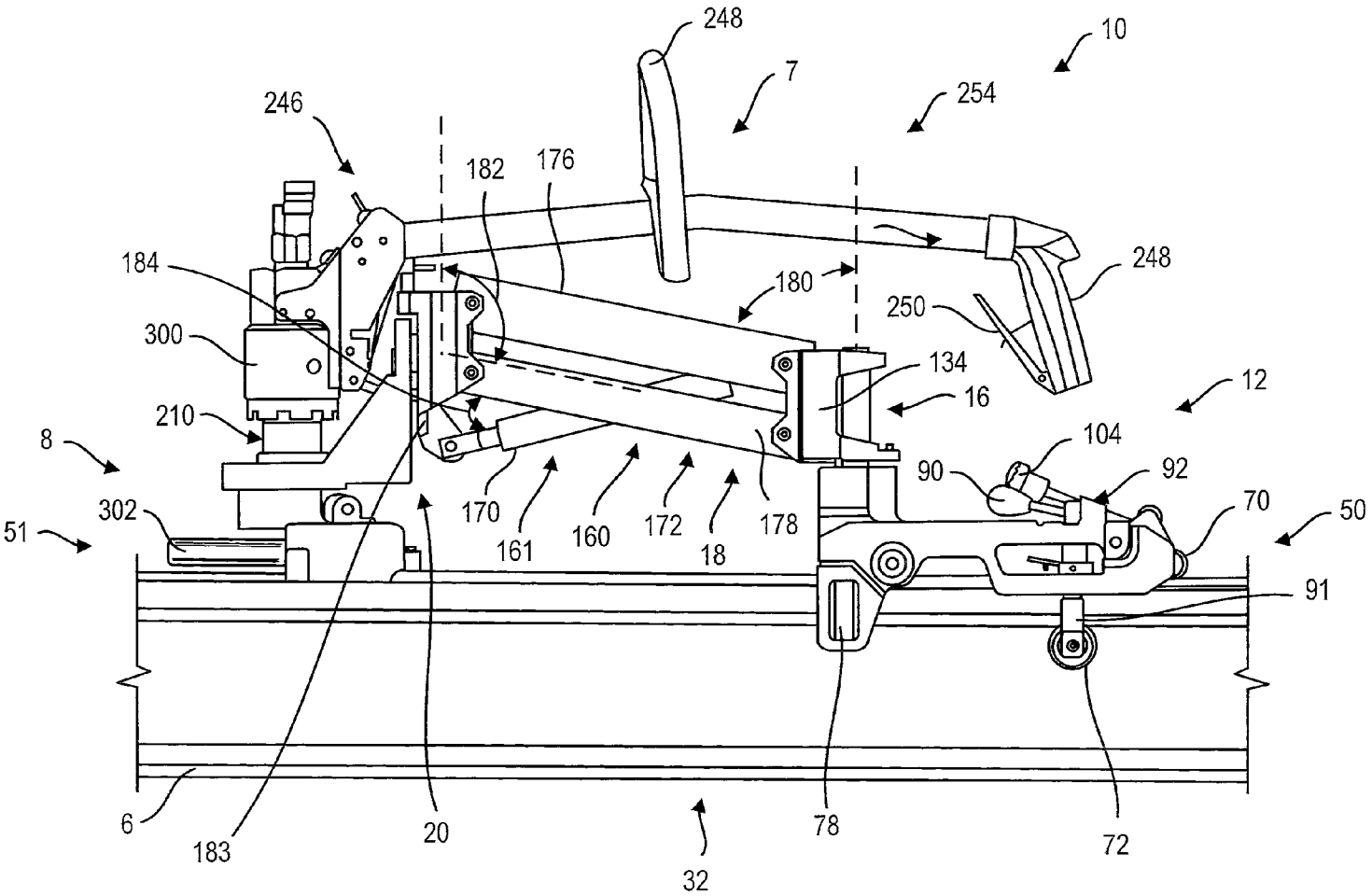
FIG. 8 illustrates a side view of the apparatus.

FIG. 8 illustrates a side view of apparatus 10 (e.g., viewed from inner side 32 of rail 6). As described above, linkage assembly 160 is configured to facilitate movement of tool 8 relative to rail 6. Linkage assembly 160 includes a spring structure 161, wherein a gravitational weight of tool 8 is countered by a spring force provided by spring structure 161. This may make it easier for a user to manipulate tool 8, for example. In some embodiments, linkage assembly 160 comprises a four bar link assembly. The four bar link assembly includes one or more upper bars 176, one or more lower bars 178, a gas spring 170, and/or other components. The description of gas spring 170 is not intended to be limiting. For example, gas spring 170 may be any type of spring that functions as described herein (e.g., a tension spring, a compression spring, a torsion spring, and/or other springs). One side of the four bar link assembly toward pivot 16 may be formed by collar portion 134 of pivot 16. An opposite side of the four bar link assembly toward head 20 may be formed by a coupling portion 183 of head 20. Upper and lower bars 176, 178, and/or gas spring 170 may extend along arm 18 between pivot 16 and head 20. Upper and lower bars 176, 178 may be coupled with pivot 16 via collar portion 134 and/or head 20 via coupling portion 183 such that upper and lower bars 176 and 178 remain substantially parallel to each other when arm 18 is moved. Upper and lower bars 176, 178 may be coupled with pivot 16 and head 20 such that an angle 180 between pivot 16 and arm 18 and/or an angle 182 between arm 18 and tool 8 changes during movement.

Gas spring 170 may comprise a compressed gas contained in a cylinder, a piston that moves within the cylinder to compress and/or decompress the gas, and/or other components that cause gas spring 170 (e.g., and/or other springs as described above) to exert the spring force that counters the gravitational weight (e.g., the gravitational reaction force) of tool 8. The spring force provided by gas spring 170 may be translated via the other components of system 10 (e.g., head 20, arm 18, pivot 16, clamp assembly 12) to the user manipulating tool 8 via handle 7, which may help the user manipulate tool 8. Gas spring 170 may be coupled to upper bar 176 and/or lower bar 178 such that an angle 184 between gas spring 170 and upper and lower bars 176 and 178 changes when arm 18 is moved by a user. Four bar link assembly 172 including gas spring 170 is configured to support the weight of tool 8 such that the perceived weight of tool 8 felt by the user is reduced compared to the actual weight of tool 8. This may make tool 8 easier to manipulate and/or otherwise move (e.g., via handle 7) for a user, and/or have other purposes.

As described above, in some embodiments, four bar link assembly 172 may be formed by portions of pivot 16 (e.g., collar portion 134), head 20 (coupling portion 183), coupling mechanisms that couple these components together, and/or other components of system 10. When a user manipulates handle 7 to move tool 8, force provided by gas spring 170 (e.g., and/or other springs) is translated through upper and lower bars 176 and 178, collar portion 134, and coupling portion 183 to the handle to counter the weight of tool 8 (e.g., during movement of tool 8 via handle 7). This may make it easier for the user to manipulate tool 8 for example, As described above, in some embodiments, gas spring 170 may be and/or include a tension spring, a compression spring, a torsion spring, and/or other springs. The weight of tool 8 and/or arm 18 may be applied to spring 170 via a lower mounting point 61 (FIG. 8), and/or an upper mounting point formed by coupling portions 138 and/or coupling mechanisms 139 (shown in FIG. 5). Rotational loads may be carried by one or more components including bars 176, 178, collar portion 134, coupling devices 199 (FIG. 9 described below), and/or other components.

Figure 9:
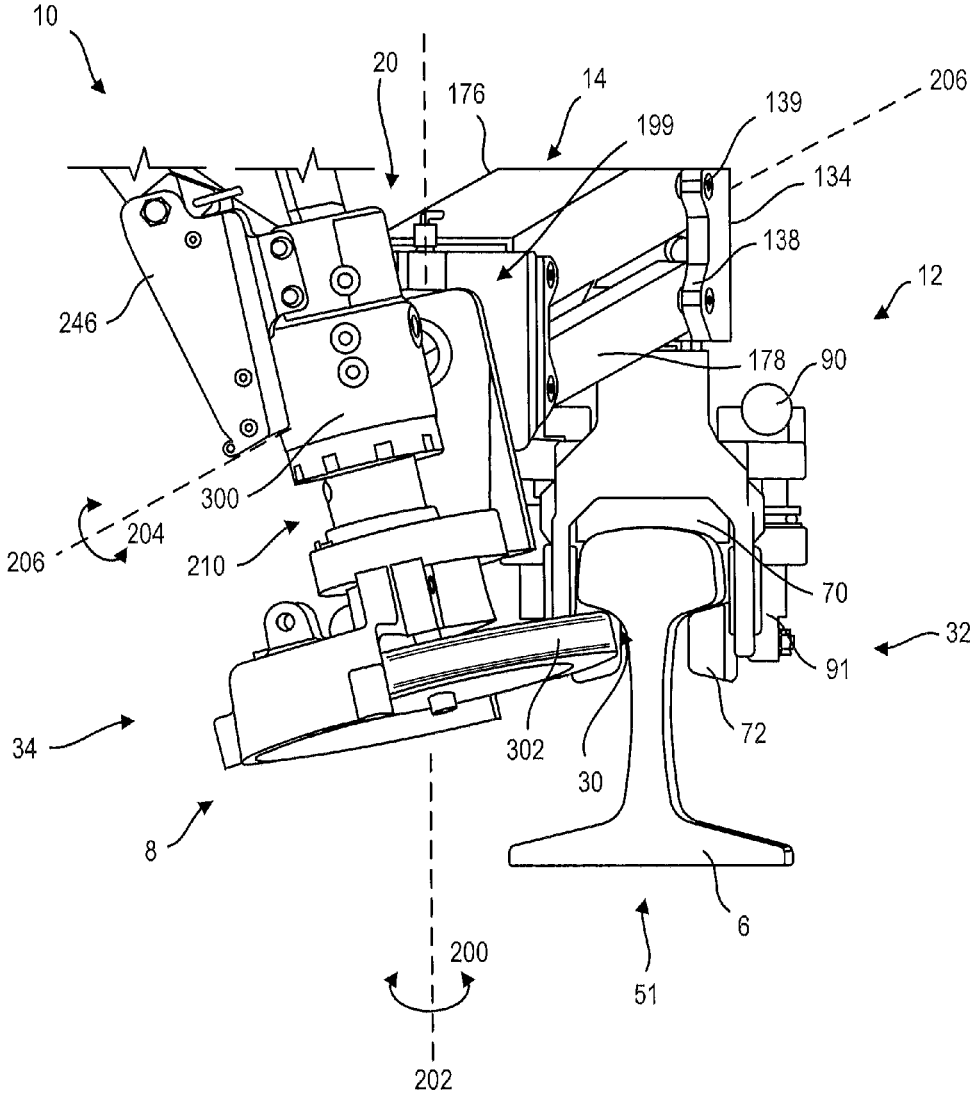
FIG. 9 illustrates an end view of the apparatus showing the tool performing an operation on the rail.

FIG. 9 illustrates an end view of apparatus 10 (e.g., looking from a second end 51 (shown in FIG. 1) of apparatus 10). FIG. 9 illustrates head 20 coupled with coupling 14 at second end 152 of arm 18. Head 20 couples tool 8 to coupling 14 toward second end 51 of apparatus 10. Head 20 may be coupled with coupling 14 via one or more head coupling devices 199 such as brackets, nuts, bolts, screws, fasteners, clamps, clips, hinges, sleeves, blocks, dowels, pins, and/or other coupling devices. As shown in FIG. 9, head 20 is configured to rotate 200 about a first axis 202 such that tool 8 is moveable toward and away from inner side 32 or outer side 34 of rail 6 (tool 8 is shown positioned on outer side 34 of rail 6 in FIG, 9), and rotate 204 about a second axis 206 such that tool 8 is moveable toward and away from underside 30 of rail 6 (e.g., allowing tool 8 to reach underneath the wide portion of the "T" shape of rail 6 described above). In some embodiments, head 20 comprises a gimbal rotation mechanism 210. In some embodiments, gimbal rotation mechanism 210 is a double gimbal rotation mechanism. Tool 8 is coupled to gimbal rotation mechanism 210 via a bearing and/or other coupling devices. Such coupling devices may include a sealed bearing and/or other bearings, for example. This may allow gimbal rotation mechanism 210 to rotate about axis 202 for example. Gimbal rotation mechanism 210 may include a base, an inner gimbal rotation mechanism, an outer gimbal rotation mechanism, and/or other components. The inner gimbal rotation mechanism and the outer gimbal rotation mechanism may be coupled via revolute joints and/or other mechanisms. In some embodiments, axis 202 may be a primary axis of rotation and axis 206 may be a second selectable axis of rotation. It should be noted that the description herein of the double gimbal rotation mechanism is not intended to be limiting. In some embodiments, the gimbal rotation mechanism may be a three axis rotation mechanism including any components and/or having any structure configured for three axis rotation.

For example, in some embodiments, head 20 comprises a hard stop and a retractable pin lock that limit the rotation of head 20 about axis 206. Head 20 may be configured such that first axis 202 is a substantially vertical axis and second axis 206 is a substantially horizontal axis relative to rail 6. In some embodiments, head 20 may be configured to rotate 200 360 degrees about first axis 202. In some embodiments, head 20 may be configured to rotate 204 about second axis 206 up to about +/−45 degrees in either direction around axis 206. In some embodiments, head 20 may be configured to rotate about second axis 206 from between about +/−10 degrees to about +/−45 degrees in either direction around second axis 206. In some embodiments, head 20 may be configured to rotate 204 about second axis 206 about +/−20 degrees in either direction around axis 206.

Returning to FIG. 1, tool 8 is configured to perform an operation to rail 6 of the railroad track. In some embodiments, tool 8 is configured to perform the operation to both rails (e.g., one rail at a time) of the railroad track while remaining mounted to only rail 6. For example, tool 8 may be mounted to rail 6 and used to perform the operation on rail 6, but then stretched via coupling 14 to the other rail of the railroad track to perform the operation on the other rail. Tool 8 may be and/or include a manually operated tool and/or other tools. A manually operated tool may be a tool that is manipulated by a user and/or a tool that has other properties. Such manipulation may include lifting, pushing, pulling, and/or otherwise moving tool 8 into position to perform the operation; turning tool 8 on and/or off; and/or other manipulation. In some embodiments, tool 8 is a grinder (e.g., as illustrated in FIG. 1), an inspection device, a spike puller, an impact wrench, a tie tamper, a spike driver, and/or other tools. In some embodiments, tool 8 includes one or more of a motor 300, a grinding stone 302, a camera, and/or other components. In some embodiments, the operation performed by tool 8 to the rail 6 comprises a grinding operation, an inspection operation, and/or other operations. For example, apparatus 10 is configured such that tool 8 may be used to grind and/or inspect inner side 32 of rail 6, outer side 34 of rail 6, underside 30 of rail 6, upper side 36 of rail 6 and/or other portions of rail 6.

As shown in FIG. 1, tool 8 includes a handle 7. Handle 7 is configured such that a user may manipulate tool 8 via handle 7 to perform the operation to rail 6, In some embodiments, handle 7 may have a generally arcuate shape and/or other shapes. Handle 7 may include one or more grip portions 248 that are gripped by a user to manipulate tool 8. Handle 7 may include a trigger 250 operatively coupled with a motor, a camera, and/or other components of tool 8 configured to facilitate performance of the operation on rail 6 by tool 8, For example, trigger 250 may be and/or include an on/off switch, a rotational speed control (e.g., for a grinder), a camera recording button, a camera picture acquisition button, and/or other triggers.

Handle 7 may be moved between a "use" position and a folded position. FIG. 1 illustrates handle 7 in "use" position 252. FIG. 8 illustrates handle 7 in folded position 254. Handle 7 may be moved between the "use" position and the folded position via a folding mechanism 246, and/or other components of apparatus 10. Folding mechanism 246 may include brackets, nuts, bolts, screws, fasteners, clamps, clips, hinges, sleeves, blocks, dowels, pins, and/or other devices. Trigger 250 described above may operate when handle 7 is in use position 252 but be prevented from operating when handle 7 is in folded position 254. Trigger 250 may be prevented from operating by a mechanical interlock and/or other devices included in tool 8, for example. In "use" position 252 (FIG. 1), handle 7 extends from head 20 near second end 51 of apparatus 10 away from rail 6 in a direction that is substantially normal to upper side 36 of rail 6. In folded position 254 (FIG. 8), handle 7 extends from head 20 along coupling 14 (and/or rail 6) toward first end 50 of apparatus 10. In some embodiments, trigger 250 may be positioned substantially above rollers 70, 72, and/or 74 with handle 7 in folded position 254.

Figure 10:
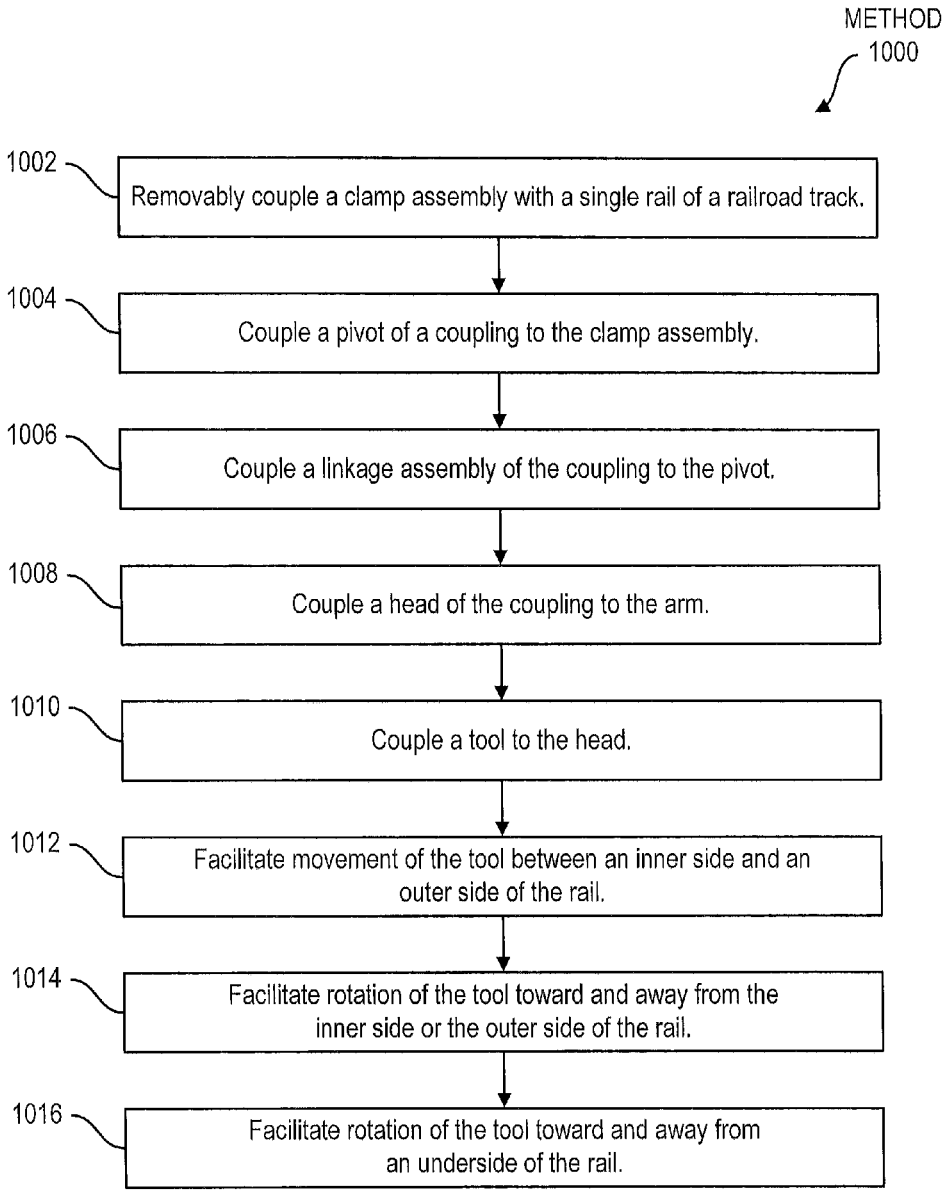
FIG. 10 illustrates a method for facilitating performance of one or more operations to one or both rails of a railroad track.

FIG. 10 illustrates method 1000 for facilitating performance of grinding, inspection, and/or other operations to one or both rails of a railroad track, Method 1000 may be performed with a railroad track tool apparatus and/or other devices. The apparatus comprises a tool, a clamp assembly, a coupling, and/or other components. The operations of method 1000 presented below are intended to be illustrative. In some embodiments, method 1000 may be accomplished with one or more additional operations not described, and/or without one or more of the operations discussed. Additionally, the order in which the operations of method 1000 are illustrated in FIG. 10 and described below is not intended to be limiting.

At an operation 1002, the clamp assembly is removably coupled with a single rail of a railroad track. The clamp assembly is moveable between a clamped position and an unclamped position to removably couple the tool with the rail, The clamp assembly comprises a first roller/bearing structure configured to engage an upper side of the rail, and second and third rollers/bearing structures configured to engage an underside of the rail when the clamp assembly is in the clamped position, The clamp assembly is moveable along the rail. The coupling is configured to couple the tool to the clamp assembly.

The clamp assembly further comprises fourth and fifth rollers/bearing structures configured to move along an inner side and an outer side of the rail to facilitate the movement of the clamp assembly along the rail without binding against the rail, a lever, an adjustment structure, and/or other components. The second and third rollers/bearing structures rotate toward the rail to engage the underside of the rail and rotate away from the rail to disengage the underside of the rail. The lever is configured to, when actuated by a user, cause the second and third rollers/bearing structures to engage or disengage the underside of the rail. The adjustment structure is configured to adjust a distance between a sixth roller/bearing structure and the second and third rollers/bearing structures. Operation 1002 may be performed by a clamp assembly that is the same as or similar to clamp assembly 12 (shown in FIG. 1 and described herein).

At an operation 1004, a pivot of the coupling is coupled to the clamp assembly. The pivot is configured to facilitate rotation of the coupling to move the tool between an inner side and an outer side of the rail, In some embodiments, the clamp assembly is configured such that the sixth, second, and third rollers/bearing structures are disposed toward a first end of the clamp assembly; the first, fourth, and fifth rollers/bearing structures are disposed toward a second end of the clamp assembly; and the coupling is coupled to the clamp assembly toward the second end of the clamp assembly near the first, fourth, and fifth rollers/bearing structures. In some embodiments, the first end of the clamp assembly is clamped to the rail and the pivot couples the coupling to the clamp assembly toward the second end of the clamp assembly, In some embodiments, the coupling has a first end and a second end opposite the first end, and the coupling is coupled to the clamp assembly via the pivot toward the first end of the coupling, In some embodiments, the clamp assembly extends along the rail from the first end of the clamp assembly to the second end of the clamp assembly, and the pivot is positioned above the rail and couples the coupling to the clamp assembly toward the second end of the clamp assembly. In some embodiments, the pivot includes a hard stop and a retractable detent configured to limit rotation of the coupling, In some embodiments, the hard stop and retractable detent are configured to allow enough rotation of the coupling such that the tool is positionable on the inner side or the outer side of the rail, Operation 1004 may be performed by a pivot that is the same as or similar to pivot 16 (shown in FIG. 1 and described herein).

At an operation 1006, a linkage assembly of the coupling is coupled to the pivot. The linkage assembly is moveable to position the tool on the outer side or the inner side of the rail, The linkage assembly is configured to facilitate movement of the tool toward and away from the rail. The linkage assembly includes a spring structure, wherein a gravitational weight of the tool is countered by a spring force provided by the spring structure. This may make it easier for a user to manipulate the tool, for example. The linkage assembly comprises a four bar link assembly. The spring structure of the linkage assembly includes a gas spring and/or other springs such as a tension spring, a compression spring, a torsion spring, etc. The four bar link assembly and the gas spring (and/or other springs) are configured to support the weight of the tool such that the perceived weight of the tool felt by the user is reduced compared to the actual weight of the tool. In some embodiments, the linkage assembly comprises an arm. The arm has a first end and a second end opposite the first end, and the arm is coupled to the clamp assembly via the pivot toward the first end of the arm. The arm extends away from the pivot, and the tool is coupled with the coupling toward the second end of the arm. Operation 1006 may be performed by a linkage assembly that is the same as or similar to linkage assembly 160 (shown in FIG. 1 and described herein).

At an operation 1008, a head of the coupling is coupled with the arm. At an operation 1010, the tool is coupled to the head, The head is configured to rotate about a first axis such that the tool is moveable toward and away from the inner side or the outer side of the rail, and rotate about a second axis such that the tool is moveable toward and away from the underside of the rail. In some embodiments, the head comprises a gimbal rotation mechanism. The tool is coupled to the gimbal rotation mechanism via a bearing and/or other coupling devices. Such coupling devices may include a sealed bearing and/or other bearings, for example. In some embodiments, the gimbal rotation mechanism is a double gimbal rotation mechanism. The gimbal rotation mechanism includes a base, an inner gimbal rotation mechanism, an outer gimbal rotation mechanism, and/or other components, The inner gimbal rotation mechanism and the outer gimbal rotation mechanism are coupled via revolute joints. In some embodiments, the head further comprises a hard stop and a retractable pin lock that limit the rotation of the head about the second axis. In some embodiments, the head is configured such that the first axis is a substantially vertical axis and the second axis is a substantially horizontal axis relative to the rail. As described above, the description herein of the double gimbal rotation mechanism is not intended to be limiting. In some embodiments, the gimbal rotation mechanism may be a three axis rotation mechanism including any components and/or having any structure configured for three axis rotation. Operation 1008 and/or operation 1010 may be performed by a head that is the same as or similar to head 20 (shown in FIG. 1 and described herein).

At an operation 1012, movement of the tool between an inner side and an outer side of the rail is facilitated. Operation 1012 may be performed by a coupling (e.g., a pivot, a linkage assembly, and/or a head) that is the same as or similar to coupling 14 (shown in FIG. 1 and described herein).

At an operation 1014, rotation of the tool toward and away from the inner side or the outer side of the rail is facilitated. Rotation of the tool toward and away from the inner side or the outer side of the rail may be manually performed by a user, for example. Operation 1014 may be performed by a head of a coupling that is the same as or similar to head 20 of coupling 14 (shown in FIG. 1 and described herein).

At an operation 1016, rotation of the tool toward and away from an underside of the rail is facilitated. Rotation of the tool toward and away from the underside of the rail may be manually performed by a user, for example. Operation 1016 may be performed by a head of a coupling that is the same as or similar to head 20 of coupling 14 (shown in FIG. 1 and described herein).

Although the disclosure has been described in detail for the purpose of illustration based on what is currently considered to be the most practical and preferred embodiments, it is to be understood that such detail is solely for that purpose and that the disclosure is not limited to the disclosed embodiments, but, on the contrary, is intended to cover modifications and equivalent arrangements that are within the spirit and scope of the appended claims. For example, it is to be understood that the present disclosure contemplates that, to the extent possible, one or more features of any embodiment can be combined with one or more features of any other embodiment.

What is claimed is:

1. A railroad track tool apparatus comprising:

a tool configured to perform an operation to a rail of a railroad track, the rail comprising an upper portion, an elongated central portion, and a lower portion;

a clamp assembly moveable between a clamped position and an unclamped position to removably couple the tool with the rail, the clamp assembly comprising:

a first bearing structure configured to engage an upper side of the upper portion of the rail; and second and third bearing structures configured to engage an underside of the upper portion of the rail on opposite sides of the elongated central portion of the rail when the clamp assembly is in the clamped position, the clamp assembly moveable along the rail; and a coupling configured to couple the tool to the clamp assembly.

2. A railroad track tool apparatus comprising:

a tool configured to perform an operation to a rail of a railroad track, wherein the tool is a grinder, and wherein the operation performed by the grinder to the rail of the railroad track comprises a grinding operation;

a clamp assembly moveable between a clamped position and an unclamped position to removably couple the tool with the rail, the clamp assembly comprising:

a first bearing structure configured to engage an upper side of the rail; and second and third bearing structures configured to engage an underside of the rail when the clamp assembly is in the clamped position, the clamp assembly moveable along the rail; and a coupling configured to couple the tool to the clamp assembly.

3. The apparatus of claim 2, wherein the clamp assembly further comprises a lever, the lever configured to, when actuated by a user, cause the second and third bearing structures to engage or disengage the underside of the rail.

4. The apparatus of claim 2, wherein the clamp assembly is configured such that the second and third bearing structures rotate toward the rail to engage the underside of the rail and rotate away from the rail to disengage the underside of the rail.

5. The apparatus of claim 2, wherein the clamp assembly further comprises fourth and fifth bearing structures configured to move along an inner side and an outer side of the rail to facilitate movement of the clamp assembly along the rail without binding against the rail.

6. The apparatus of claim 5, wherein the clamp assembly is configured such that the second and third bearing structures are disposed toward a first end of the clamp assembly; and the first, fourth, and fifth bearing structures are disposed toward a second end of the clamp assembly; and wherein the coupling is coupled to the clamp assembly toward the second end of the clamp assembly near the first, fourth, and fifth bearing structures.

7. The apparatus of claim 6, further comprising an adjustment structure configured to adjust a distance between a sixth bearing structure and the second and third bearing structures.

8. The apparatus of claim 7, wherein the first, second, third, fourth, fifth, and sixth bearing structures each comprise an individual roller.

9. The apparatus of claim 2, wherein the coupling includes a pivot, the pivot configured to facilitate rotation of the coupling to move the tool between an inner side and an outer side of the rail.

10. The apparatus of claim 2, wherein the coupling includes an arm coupled to the clamp assembly, the arm being moveable to position the tool on an outer side or an inner side of the rail.

11. The apparatus of claim 2, wherein the coupling includes a head configured to couple with the tool, the head configured to:

rotate about a first axis such that the tool is moveable toward and away from an inner side or an outer side of the rail; and rotate about a second axis such that the tool is moveable toward and away from the underside of the rail.

12. An railroad track tool apparatus comprising:

a tool configured to perform an operation to a rail of a railroad track;

a clamp assembly configured to removably couple the tool with the rail; and a coupling configured to couple the tool to the clamp assembly, the coupling comprising:

a pivot that couples the coupling to the clamp assembly, the pivot configured to facilitate rotation of the coupling to move the tool between an inner side and an outer side of the rail.

13. The apparatus of claim 12, wherein the tool is a grinder, and wherein the operation performed by the grinder to the railroad track comprises a grinding operation.

14. The apparatus of claim 12, wherein the clamp assembly has a first end that is clamped to the rail and a second end opposite the first end, and wherein the pivot couples the coupling to the clamp assembly toward the second end of the clamp assembly.

15. The apparatus of claim 14, wherein the coupling has a first end and a second end opposite the first end, wherein the coupling is coupled to the clamp assembly via the pivot toward the first end of the coupling, and wherein the tool is coupled with the coupling toward the second end of the coupling.

16. The apparatus of claim 14, wherein the clamp assembly extends along the rail from the first end of the clamp assembly to the second end of the clamp assembly, and wherein the pivot is positioned above the rail and couples the coupling to the clamp assembly toward the second end of the clamp assembly.

17. The apparatus of claim 12, wherein the pivot includes a hard stop and a retractable detent configured to limit rotation of the coupling.

18. The apparatus of claim 17, wherein the hard stop and retractable detent are configured to allow enough rotation of the coupling such that the tool is positionable on the inner side or the outer side of the rail.

19. The apparatus of claim 12, wherein the clamp assembly is moveable between a clamped position and an unclamped position to removably couple the tool with the rail, the clamp assembly comprising:

a first bearing structure configured to engage an upper side of the rail; and second and third bearing structures configured to engage an underside of the rail when the clamp assembly is in the clamped position, the clamp assembly moveable along the rail.

20. The apparatus of claim 19, wherein the first, second, and third bearing structures each comprise an individual roller.

21. The apparatus of claim 12, wherein the coupling includes an arm coupled to the clamp assembly via the pivot, the arm being moveable to position the tool on the outer side or the inner side of the rail.

22. The apparatus of claim 12, wherein the coupling includes a head configured to couple with the tool, the head configured to:

rotate about a first axis such that the tool is moveable toward and away from the inner side or the outer side of the rail; and rotate about a second axis such that the tool is moveable toward and away from an underside of the rail.

23. A railroad track tool apparatus comprising:

a tool configured to perform an operation to the rail of the railroad track;

a clamp assembly configured to removably couple the tool with the rail; and a coupling configured to couple the tool to the clamp assembly, the coupling comprising:

a linkage assembly configured to facilitate movement of the tool toward and away from the rail, the linkage assembly including a spring structure, wherein a gravitational weight of the tool is countered by a spring force provided by the spring structure.

24. The apparatus of claim 23, wherein the tool is a grinder, and wherein the operation performed by the grinder to the railroad track comprises a grinding operation.

25. The apparatus of claim 23, wherein the linkage assembly comprises a four bar link assembly.

26. The apparatus of claim 25, wherein the spring structure of the linkage assembly includes a gas spring, the four bar link assembly and the gas spring configured to support the weight of the tool such that a perceived weight of the tool felt by the user is reduced compared to an actual weight of the tool.

27. The apparatus of claim 23, wherein the clamp assembly is moveable between a clamped position and an unclamped position to removably couple the tool with the rail, the clamp assembly comprising:

a first bearing structure configured to engage an upper side of the rail; and second and third bearing structures configured to engage an underside of the rail when the clamp assembly is in the clamped position, the clamp assembly moveable along the rail.

28. The apparatus of claim 27, wherein the first, second, and third bearing structures each comprise an individual roller.

29. The apparatus of claim 23, wherein the coupling includes a pivot and the linkage assembly comprises an arm coupled to the clamp assembly via the pivot, the pivot configured to facilitate rotation of the arm to move the tool between an inner side and an outer side of the rail.

30. The apparatus of claim 29, wherein the arm has a first end and a second end opposite the first end, wherein the arm is coupled to the clamp assembly via the pivot toward the first end of the arm.

31. The apparatus of claim 30, wherein the arm extends away from the pivot, and wherein the tool is coupled with the coupling toward the second end of the arm.

32. The apparatus of claim 23, wherein the coupling includes a head configured to couple with the tool, the head configured to:

rotate about a first axis such that the tool is moveable toward and away from an inner side or an outer side of the rail; and rotate about a second axis such that the tool is moveable toward and away from an underside of the rail.

33. The apparatus of claim 23, wherein the linkage assembly is moved by the user via a tool handle to position the tool on an outer side or an inner side of the rail.

34. A railroad track tool apparatus comprising:

a tool configured to perform an operation to the rail of the railroad track;

a clamp assembly configured to removably couple the tool with the rail; and a coupling configured to couple the tool to the clamp assembly, the coupling comprising:

a head configured to couple with the tool, the head configured to:

rotate about a first axis such that the tool is moveable toward and away from an inner side or an outer side of the rail; and rotate about a second axis such that the tool is moveable toward and away from an underside of the rail.

35. The apparatus of claim 34, wherein the tool is a grinder, and wherein the operation performed by the grinder to the railroad track comprises a grinding operation.

36. The apparatus of claim 34, wherein the head comprises a double gimbal rotation mechanism.

37. The apparatus of claim 36, wherein the tool is coupled to the double gimbal rotation mechanism via a sealed bearing.

38. The apparatus of claim 36, wherein the double gimbal rotation mechanism includes a base, an inner gimbal rotation mechanism, and an outer gimbal rotation mechanism, wherein the inner gimbal rotation mechanism and the outer gimbal rotation mechanism are coupled via revolute joints.

39. The apparatus of claim 34, wherein the head further comprises a hard stop and a retractable pin lock that limit the rotation of the head about the second axis.

40. The apparatus of claim 34, wherein the head is configured such that the first axis is a substantially vertical axis and the second axis is a substantially horizontal axis relative to the rail.

41. The apparatus of claim 34, wherein the clamp assembly is moveable between a clamped position and an unclamped position to removably couple the tool with the rail, the clamp assembly comprising:

a first bearing structure configured to engage an upper side of the rail; and second and third bearing structures configured to engage an underside of the rail when the clamp assembly is in the clamped position, the clamp assembly moveable along the rail.

42. The apparatus of claim 41, wherein the first, second, and third bearing structures each comprise an individual roller.

43. The apparatus of claim 34, wherein the coupling includes a pivot, the coupling coupled to the clamp assembly via the pivot, the pivot configured to facilitate rotation of the coupling including the head to move the tool between the inner side and the outer side of the rail.

44. The apparatus of claim 34, wherein the coupling includes an arm coupled to the clamp assembly, the arm being moveable to position the tool on the outer side or the inner side of the rail.

* * * * *